US005152425A

United States Patent [19]

Baudin

[11] Patent Number: 5,152,425

[45] Date of Patent: Oct. 6, 1992

[54] SPRAYING PROCESS WITH THE AID OF A MANUAL PUMP ATOMISER AND MANUAL PUMP ATOMISER FOR THE IMPLEMENTATION OF THE PROCESS

[75] Inventor: Gilles Baudin, Clichy, France

[73] Assignee: L'Oreal, Paris, France

[21] Appl. No.: 660,140

[22] Filed: Feb. 25, 1991

[30] Foreign Application Priority Data

Apr. 19, 1990 [FR] France ..... 90 04994

[51] Int. Cl.[5] ..... B05B 15/08

[52] U.S. Cl. ..... 222/1; 222/321; 222/404; 222/505; 222/526; 239/587.5

[58] Field of Search ..... 222/321, 404, 372, 383, 222/385, 505, 519, 526, 402.13, 402.14, 402.11, 1; 239/333, 329, 331, 587

[56] References Cited

U.S. PATENT DOCUMENTS

| | | | |
|---|---|---|---|
| 4,111,367 | 9/1978 | Hayes | 222/321 X |
| 4,124,148 | 11/1978 | Vieler et al. | 222/321 |
| 4,186,855 | 2/1980 | Edman et al. | 222/321 |
| 4,433,799 | 2/1984 | Corsette | 222/320 X |

*Primary Examiner*—David H. Bollinger
*Attorney, Agent, or Firm*—Cushman, Darby & Cushman

[57] ABSTRACT

A process and device for atomizing spray dispensing of a liquid product from a container includes a manually actuated push button pump which moves a movable member including a spray orifice along an axis while simultaneously rotating the spray orifice about the axis.

9 Claims, 2 Drawing Sheets

SPRAYING PROCESS WITH THE AID OF A MANUAL PUMP ATOMISER AND MANUAL PUMP ATOMISER FOR THE IMPLEMENTATION OF THE PROCESS

This invention relates to a spraying process with the aid of a manual pump atomiser for improving the distribution of the atomised product and a manual pump atomiser for the implementation of the process.

When spraying a liquid or slightly viscous product over a surface, it is necessary, on the one hand, to measure out the quantity of product sprayed over a given area and, on the other hand, to ensure that the atomised product is distributed as homogeneously as possible over the said surface. E.g. when spraying lacquer on to the hair, if it is not distributed homogeneously, or if too great a quantity is sprayed on, there may be zones in which the hair looks damp, resulting in zones of hair resembling cardboard once the lacquer has dried.

In the case of a manual pump atomiser, the quantity of product sprayed on can be metered in a simple manner by the number of pumping operations effected by the user (i.e. the number of pump actuating movements).

In order to obtain homogeneous distribution over the target surface, one solution would be to move the atomiser manually relative to the target surface during spraying. However, when a user uses a pump atomiser, it can be difficult to control the distribution of the atomised product over the target surface in this manner, as the movements required to pump the product to be sprayed and to move the atomiser must be performed simultaneously. The heavier the atomiser and the more difficult the surface is to aim at, the greater this problem becomes. Therefore, in many cases it is difficult for the user to obtain homogeneous distribution of the product and there is a risk of zones of accumulation occurring on the target surface when the user presses on the device serving to actuate the pump.

It has been proposed to reduce the density of the atomised product by increasing the surface over which the atomised product is to be deposited, by increasing the spray angle. However, in this case, there is an increased risk of part of the atomised product being sprayed outside the target surface. E.g. in the case where lacquer is being sprayed on to the hair of a client, there is a risk of the lacquer being sprayed over the client's clothes or into the client's eyes.

According to the invention, it has been found that it is possible to improve the distribution of the atomised product over a surface and to prevent the formation of zones of excessive accumulation of the atomised product by rotating the spray orifice of the manual pump atomiser between two extreme positions in order to cover a wider surface with each pumping operation, with the aid of the jet of the atomised substance, without manual displacement of the pump atomiser being necessary.

Therefore, the object of this invention is a process for spraying a liquid product with the aid of a manual pump atomiser, the product to be sprayed being held in a container, to which is fixed the fixed part of a manual dispensing pump, the movable part of which is associated with a push-button, the said push-button allowing for translation of the movable part of the pump relative to the fixed part in order to effect delivery, the said push-button being provided with a spray orifice supplied with the product to be sprayed via a delivery channel connected to the movable part of the pump, characterised in that a movement of rotation about the axis of the pump between two extreme positions is imparted to the spray orifice during each translational movement of the push-button.

The two extreme positions are advantageously those positions occupied by the orifice at the two ends of the stroke of the push-button and the movable part of the pump. In these two extreme positions, the orifice is situated in axial planes including a predetermined angle between them, possibly at different heights relative to the container.

The angle between the two axial planes passing through the axis of the pump and closing the spray orifice in the two extreme positions is between 10° and 50°. It is preferably in the region of 20°.

In the process of the invention, it will be seen that the spray orifice begins to rotate with each pump actuating movement, means being provided to ensure that the pump actuating movement is accompanied by rotation of the spray orifice.

By virtue of the rotation of the spray orifice, the quantity of product sprayed on with one pumping operation is distributed over a larger surface. E.g. if the angle of the atomising cone of the product is 20° and the angle of rotation is 40°, it will be noted that for a surface situated 20 cm from the spray orifice, the zone covered by spraying is at least four times greater than it is when there is no rotation of the spray orifice. The average density of the atomised droplets is therefore lower. This therefore reduces the risk of the formation of zones of accumulation of the atomised product and the resulting disadvantages.

Rotation of the spray orifice is advantageously obtained by the sliding of at least one lug integral with the push-button associated with the movable part of the pump into at least one groove formed in an element connected to the fixed part of the pump, the lug sliding into the groove upon translation of the push-button. It would also be possible to form a groove of this kind in the push-button and to dispose the corresponding lug on the element connected to the fixed part of the pump. The groove can also be replaced by a ramp, a lug then butting against this ramp.

In these embodiments, the section of the groove or ramp determines the displacement of the spray orifice and its total angle of rotation.

The projection P of the groove over a plane Q perpendicular to the axial plane passing through the centre position of the delivery orifice can be a rectilinear segment of length 1 including an acute angle $\alpha$ with the axis of the pump, preferably less than 45°. The greater the length 1 and the angle $\alpha$, the greater the sweeping angle and, consequently, the larger the zone covered by spraying. The projection P of the groove can also have an elbowed shape and, inter alia, may consist of two preferably equal rectilinear segments including an angle between them, preferably an obtuse angle. When these two segments together with the projection over the plane Q of the axis of the pump form angles in opposite directions, by virtue of the elbowed section of the groove, one single operation of the pump results in double sweeping of the target surface by the atomised product. The groove can also have a curved shape in projection over the plane Q, in particular, the shape of a flattened S, as it is known that during one spraying operation of the pump, the curve giving the quantity of atomised product as a function of time is not a straight line. During spraying, an acceleration phase of the flow is generally noted initially, then, at the end, a deceleration phase. The groove section in the shape of a flattened S has the advantage of overcoming this difficulty and affording more homogeneous distribution of the atomised product.

This invention also relates to a manual pump atomiser for the implementation of the process of the invention, in which the product to be sprayed is held in a container to which is fixed the fixed part of a manual dispensing pump, the movable part of which is associated with a push-button, the said push-button allowing for translation of the movable part of the pump relative to the fixed part in order to effect delivery, the said push-button being provided with a spray orifice supplied with the product to be sprayed via a delivery channel connected to the movable part of the pump, characterised in that the push-button cooperates with a fixed element integral with the container so that it rotates about its axis upon translation of the push-button. According to a preferred embodiment, the push-button is provided on its exterior with at least one lug forming a radial projection which cooperates with a groove formed in the fixed element integral with the container. According to another embodiment, the push-button comprises a groove on its lateral wall, the fixed element of the container being provided with a lug which slides into the said grove. The cooperation of the push-button and the fixed element can also be effected by a lug simply resting against a ramp.

In a preferred embodiment, the push-button comprises, in the known manner, a substantially flat upper face, provided with a cylindrical skirt directed towards the container, the delivery orifice being formed in a patch provided on the said skirt. The fixed element is a coaxial cylindrical wall connected to the fixed part of the pump, the push-button being moved in translation opposite the said cylindrical wall so that a lug provided on one slides into a groove formed in the other. The cylindrical wall constituting the fixed element can extend over 360° about the axis of the pump or may consist simply of one (or more) cylindrical sector(s).

The delivery orifice can open at the level of the external wall of the cylindrical skirt of the push-button or can be at the end of a spout extending radially from said skirt.

The projection P of the groove over the plane Q defined hereinbefore can of course have the different shapes described hereinabove, i.e. linear, elbowed, curved or in the shape of a flattened S.

The upper face of the push-button can be smooth or grooved and can be used just as it is, particularly when the angle of rotation of the spray orifice is small, e.g. approximately 15°. In this case, the user generally does not feel the push-button rotating under his finger.

However, the upper face of the push-button can also be covered by a movable component provided on the push-button and fixed so that it can rotate freely relative to the said push-button. This arrangement is particularly advantageous when the angle of rotation is greater than approximately 15°, as the user would then be able to feel the push-button rotating under his finger. The movable component, which is interposed between the finger and the push-button, remains fixed relative to the finger, and the push-button pivots relative to the said component during translation thereof. The movable component prevents the user from feeling the push-button rotating under his finger.

It is also possible to actuate the push-button with the aid of a lever which rests against a fixed part of the atomiser according to the invention and which is not connected to the push-button, so that the push-button can be movable in rotation relative to the lever. This arrangement is particularly advantageous if the angle of rotation of the spray orifice is greater than approximately 30° and when a considerable quantity is atomised with each pumping operation.

The object of the invention will be more readily understood from the following description, gives purely by way of a non-limiting example, of several embodiments, illustrated in the accompanying drawings, in which.

Figure 1:
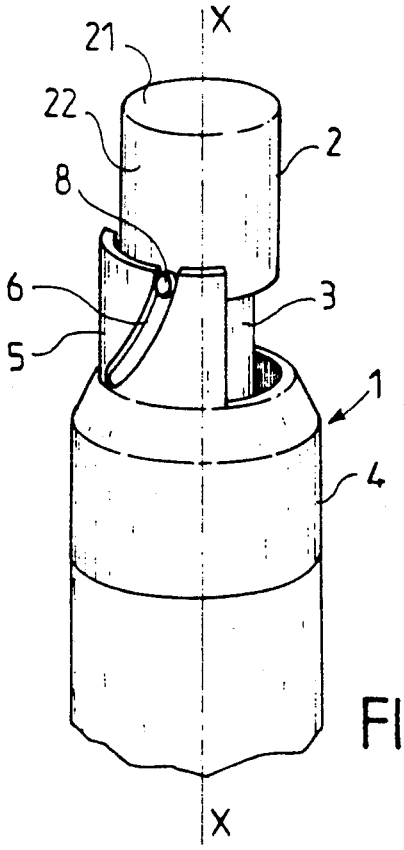
FIG. 1 shows an atomiser according to the invention, partly in perspective, in the rest position.
Figure 2:
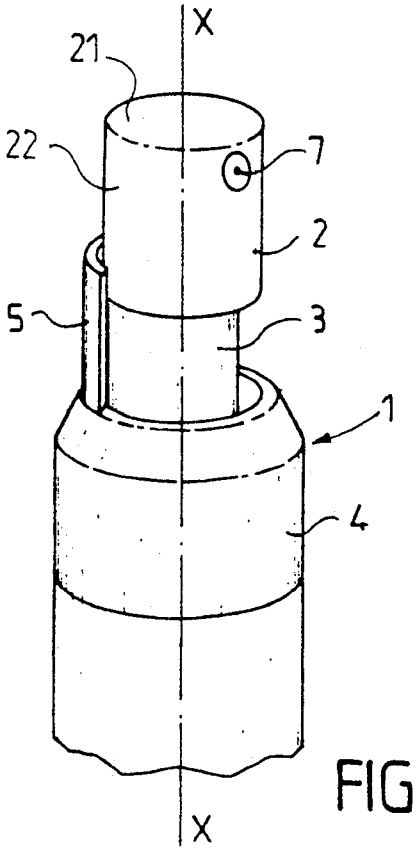
FIG. 2 shows the atomiser of FIG. 1, partly in perspective and viewed from a different angle.

FIGS. 1 and 2 show an atomiser according to the invention in the rest position, designated in general by the reference numeral 1. It comprises a pump, the movable part of which comprises a push-button 2 fixed to a rod 3 movable in translation along the axis of symmetry X—X of the distributor head and in rotation about this axis X—X. The fixed part of the pump comprises a cylindroconical skirt 4 integral with the neck (not shown) of the container. The edge of the conical part having the smallest diameter is extended by means of a partial skirt 5, consisting of a cylindrical sector. A groove 6 is formed in the partial skirt 5, said groove 6 being inclined relative to the generatrices of the skirt extending from the free upper edge of the partial skirt 5 to its junction with the cylindroconical skirt 4. The push-button 2 consists of a flat circular upper face 21 on the edge of which is disposed a cylindrical skirt 22 directed towards the container. The delivery channel (not shown) for the atomised product opens via the orifice 7 formed in a patch provided on the skirt 22 in the vicinity of the upper face 21 of the push-button 2. A lug 8, situated on a generatrix of the cylindrical skirt diametrically opposite to the one on which the spray orifice 7 is disposed, projects radially relative to the skirt 22.

Figure 3:
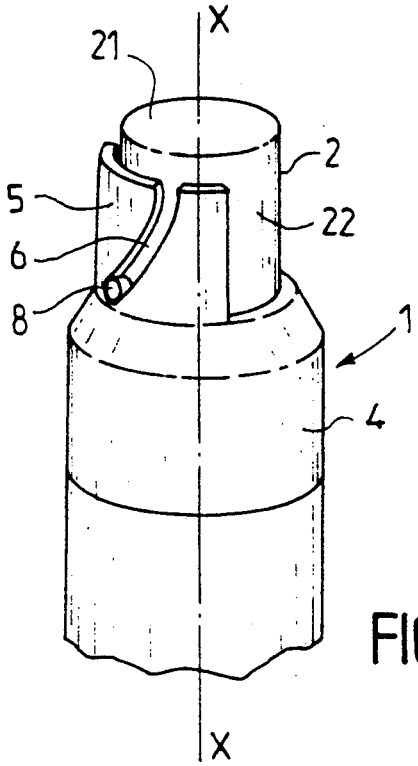
FIGS. 3 & 4 show the atomiser at the end of the spraying process, in perspective and from the same angles as FIGS. 1 and 2 respectively.
Figure 4:
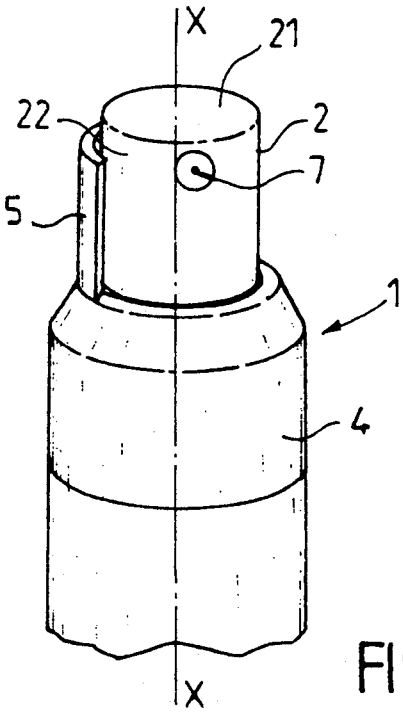

The device operates as follows: when the user wishes to spray some of the product, he presses on the upper face 21 of the push-button 2, imparts a movement of translation along the axis X—X thereto and actuates the pump. In this manner, the product to be dispensed is sprayed through the orifice 7. Simultaneously, the lug 8 fixed to the skirt 22 slides into the groove 6, resulting in rotation of the push-button 2 and the rod 3 about the axis X—X until the lug 8 butts against the lower part of the groove 6. The orifice 7, which, like the lug 8, is disposed on the skirt 22 of the push-button 2, is therefore also moved in translation along the axis X—X and is rotated between two extreme positions in response to the translational movement of the push-button. FIGS. 3 and 4 show the distributor head at the end of the pumping operation and consequently the spraying operation. It will be seen that the push-button 2 is depressed, that the lug 8 butts against the lower end of the groove 6 and that the spray orifice 7 has turned by a predetermined angle. By virtue of the rotational movement of the orifice 7, the quantity of product sprayed during one pumping operation is distributed over a larger target surface.

Figure 5:
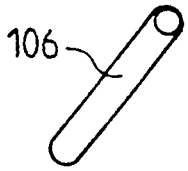
FIGS. 5 to 7 show the special shapes of the grooves.
Figure 6:
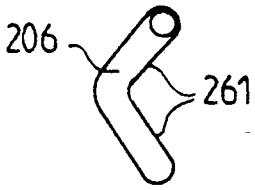
Figure 7:
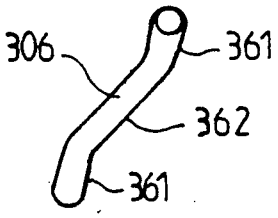

FIGS. 5 to 7 show different shapes of the groove in projection over a plane perpendicular to the axial plane passing through the centre position of the delivery orifice. In FIG. 5, the groove 106 has a rectilinear section. In FIG. 6, the groove 206 has an elbowed section. It consists of two rectilinear segments 261 including between them an obtuse angle of approximately 110°. In this manner, it is possible to obtain double sweeping of the target surface by the jet of the atomised substance with one single pumping operation. In FIG. 7, the groove 306 has the shape of a flattened S. The groove 306 consists of three linear segments. Two parallel shorter segments 361 are fixed to either end of a longer central segment 362. The segments 361 together with the segment 362 form an obtuse angle of 100° to 110°.

Figure 8:
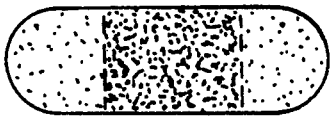
FIGS. 8 & 9 show the distribution of the product sprayed with the aid of an atomiser provided with the groove of FIG. 5 or FIG. 7 respectively.

FIG. 8 shows the distribution of the droplets of the product sprayed with each pumping operation over a given target surface when the groove 106 of rectilinear section is used. It will be seen that the central zone is only slightly coated and that the end zones are even less so.

Figure 9:
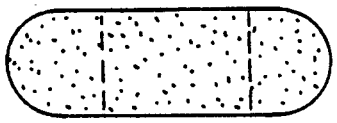

FIG. 9 shows the distribution of the droplets of the product sprayed with each pumping operation when the groove 306 in the shape of a flattened S is used. It will be seen that the density of the atomised droplets is substantially the same over the entire target surface. The distribution is therefore more homogeneous.

Figure 10:
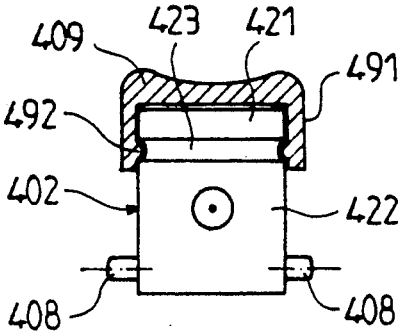
FIGS. 10 & 11 show a push-button on which a movable component is disposed.
Figure 11:
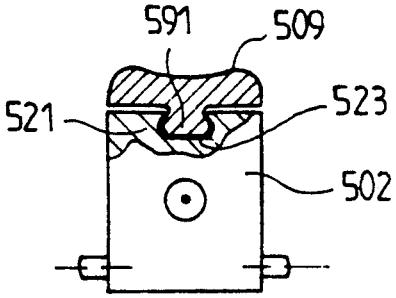

FIGS. 10 and 11 show a push-button on the upper face of which is mounted a component movable in rotation relative to the said face 421. In FIG. 10, the upper face 421 of the push-button 402 is covered by a movable component 409 provided with a cylindrical skirt 491 rotatably fixed by snap-engagement, with the aid of a flange 492, in a groove 493 of the cylindrical skirt 422 of the push-button 402. According to the embodiment shown in FIG. 10, the skirt 422 has two diametrically opposing lugs 408. These two lugs cooperate with two identical grooves (not shown). When the user presses on the movable component 409 and imparts a translational movement to the push-button 402, the movable component 409 remains stationary under the finger of the user and the push-button 402 is rotated. The user therefore does not feel the push-button rotating under his finger.

In the embodiment shown in FIG. 11, the upper face 521 of the push-button 502 is covered by a movable component 509 which is fixed by a bulbous axial projection 591 which cooperates with a corresponding axial cavity 523 formed in the upper part 521 of the push-button 502. As in the device of FIG. 10, the component 509 remains stationary under the finger of the user when he presses on the push-button 502, while the push-button 502 is rotated.

Figure 12:
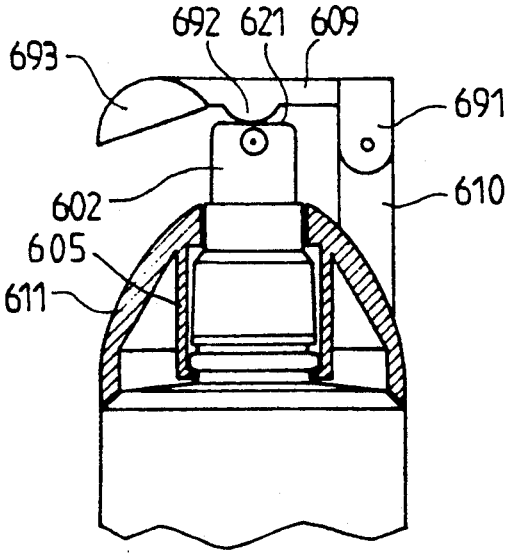
FIG. 12 shows part of an atomiser provided with a lever arm.

FIG. 12 shows an embodiment of the manual pump atomiser according to the invention, in which the user depresses the push-button 602 with the aid of a lever 609. This lever is hinged by means of at least one arm 691 on to a support 610 integral with a cap 611 fixed to the container of the atomiser and surrounding the push-button 602 and the skirt 605 comprising the groove cooperating with the lug (not shown). The support 610 projects parallel to the axis, in relation to the surface of the cap 611.

The lever 609 is provided, opposite the upper surface 621 of the push-button, with a supporting element 692 having a shape such that the push-button 602 can rotate without excessive friction relative to the lever 609. It is provided at the end opposite to the arms 691 with a surface forming a bearing surface 693 for the finger(s) of the user.

In order to actuate the pump system, the user presses on the surface 693, the supporting element 692 presses against the upper face 621 of the push-button 602 and depresses the said push-button. When depressed in this manner, the push-button 602 is rotated by the combined action of a lug and a groove (not shown).

I claim:

1. A process for spraying a liquid product by means of a manually operated pump atomiser of the type having a container for the product, the container having a pump atomiser attached to an outlet of the container, the pump atomiser having a movable member associated with a push button which is disposed, when operated by a user, to move the movable member in translation along an axis to effect dispensing of the product from the container, the movable member having a spray orifice connected to a delivery channel, the steps comprising applying pressure manually to the push button and substantially simultaneously rotating the movable member about said axis between a first and a second position while the movable member is moved along said axis in translation.

2. The invention as claimed in claim 1 including the step of rotating the spray orifice between 10° and 50° about said axis in moving between said first and second positions.

3. A manually operated pump atomiser for spraying a liquid product, said atomiser having a container for the product, said container having an outlet with said pump atomiser communicating with said outlet, said pump atomiser having a movable member associated with a push button which is disposed, when operated by a user, to move the movable member in translation along an axis to effect dispensing of the product from the container, the movable member having a spray orifice connected to a delivery channel, said atomiser including means for substantially simultaneously rotating the movable member about said axis between a first and a second position while the movable member is moved along said axis in translation in response to a user applying pressure manually to the push button.

4. The invention as claimed in claim 3 wherein said means for substantially simultaneously rotating the movable member comprises a fixed member fixed to said container and including a groove, said movable member including a lug slidably cooperating with said groove.

5. The invention as claimed in claim 3 wherein said means for substantially simultaneously rotating the movable member comprises a fixed member fixed to said container and including a ramp, said movable member including a lug slidably cooperating with said ramp.

6. The invention as claimed in claim 4 or 5 wherein said push button has a substantially flat upper face and a substantially cylindrical skirt extending from said upper face toward said container, said spray orifice being located in said skirt.

7. The invention as claimed in claim 6 wherein said upper face of said push button is covered by a movable component rotatably mounted on said upper face.

8. The invention as claimed in claim 3 wherein said means for substantially simultaneously rotating the movable member comprises a fixed member fixed to said container, said fixed member being a segment of a cylindrical wall concentrically disposed relative to said axis, one of said fixed and movable members having a groove and the other of said members having a lug engaging said groove.

9. The invention as claimed in claim 3 wherein said atomiser has a fixed element and a pivotable lever mounted on said fixed element so as to engage and actuate said push button.

* * * * *